US007410398B2

(12) United States Patent
Hunt et al.

(10) Patent No.: US 7,410,398 B2
(45) Date of Patent: Aug. 12, 2008

(54) ENGINE MOUNTED OIL TANK

(75) Inventors: Devlin A. Hunt, Winthrop Harbor, IL (US); Robert H. Trams, Twin Lakes, WI (US)

(73) Assignee: BRP US Inc., Sturtevant, WI (US)

( * ) Notice: Subject to any disclaimer, the term of this patent is extended or adjusted under 35 U.S.C. 154(b) by 757 days.

(21) Appl. No.: 10/708,090

(22) Filed: Feb. 6, 2004

(65) Prior Publication Data

US 2005/0172927 A1 Aug. 11, 2005

(51) Int. Cl.
*B63H 20/00* (2006.01)
*B63H 21/38* (2006.01)
*F01M 1/00* (2006.01)
*F01M 1/02* (2006.01)

(52) U.S. Cl. ..... 440/88 L; 123/196 R; 123/196 W

(58) Field of Classification Search ..... 440/88 R, 440/88 L, 88 HE; 123/196 R, 196 A, 196 W
See application file for complete search history.

(56) References Cited

U.S. PATENT DOCUMENTS 4,142,486 A 3/1979 Schreier
4,372,258 A 2/1983 Iwai
4,403,578 A 9/1983 Iwai et al.
4,414,929 A 11/1983 Sakurai
4,452,195 A 6/1984 Matsumoto et al.
4,471,727 A 9/1984 Odashima
4,632,085 A 12/1986 Misawa et al.
4,637,355 A 1/1987 Odashima
4,638,771 A 1/1987 Mori
4,766,860 A * 8/1988 Abe et al. ..... 123/196 A
5,460,555 A 10/1995 Fukuoka et al.
5,630,383 A 5/1997 Kidera et al.
5,632,241 A 5/1997 Binversie et al.
5,713,325 A 2/1998 Yoshida et al.
5,787,847 A 8/1998 Ozawa et al.
5,806,473 A 9/1998 Kometani et al.
5,829,401 A 11/1998 Masuda
5,941,745 A 8/1999 Kanno
6,053,785 A * 4/2000 Kato et al. ..... 440/89 R
6,390,033 B1 5/2002 Hartke et al.
6,477,992 B2 * 11/2002 Hartke et al. ..... 123/73 AD
6,626,141 B2 9/2003 Choi

FOREIGN PATENT DOCUMENTS

JP 09125926 A * 5/1997
JP 10220213 A * 8/1998

* cited by examiner

*Primary Examiner*—Ajay Vasudeva
(74) *Attorney, Agent, or Firm*—Osler, Hoskin & Harcourt LLP

(57) ABSTRACT

An oil system for an outboard motor is disclosed. The oil system has a pump disposed in an oil reservoir. The oil reservoir is attached to an engine of the outboard motor. The oil reservoir is preferably sized according to engine size to hold an average year's supply of oil.

33 Claims, 5 Drawing Sheets

ENGINE MOUNTED OIL TANK

BACKGROUND OF INVENTION

The present invention relates generally to outboard motors, and more particularly, to an oil distribution system mounted to an engine of an outboard motor.

Two-stroke, or two-cycle engines, have the advantage of not having an oil sump as is required in four-stroke engines and, therefore, do not require frequent oil changes. Further, there are significant weight savings in two-stroke engines, and the modern two-stroke engines, such as that used in the EVINRUDE outboard motor, are highly fuel efficient and have extremely low emission characteristics.

Older two-stroke engines required that the oil be manually mixed with the gas before placed in a fuel tank for the engine. Many newer engines use an internal automated mixing technique that injects oil into the gas. Other newer engines incorporate oil injection systems that directly inject oil into the engine. The oil injection systems have an oil tank or reservoir containing a quantity of oil for use in the injection system. The oil tank, however, is usually located remotely, such as in a boat, which is sometimes inconvenient and requires an oil line and electrical connection extending between the boat and the engine. Further, such systems typically require a lift pump in or near the remote tank in addition to a pressure pump at the engine.

It would therefore be desirable to have an engine oil distribution system capable of being completely enclosed about the motor.

BRIEF DESCRIPTION OF INVENTION

The present invention provides an oil distribution system that solves the aforementioned problems. The oil distribution system of the present invention provides lubricating oil to an engine from an oil reservoir mounted on the engine, preferably, in an outboard motor. An oil tank is mounted to the engine under the cowling of the outboard motor. A single oil pump located within the oil tank supplies the engine with lubricating oil.

Therefore, in accordance with one aspect of the present invention, a lubrication system for an engine is arranged about the engine. An oil reservoir is mounted in close proximity to the engine and a pump is disposed within the oil reservoir.

According to another aspect of the present invention, an outboard motor has a two-stroke direct fuel injected engine mounted on a midsection of an outboard motor. The outboard motor also has a housing cover positioned about the engine and an oil tank positioned in the housing. A pump is disposed within the oil tank and in fluid communication with the engine.

According to a further aspect of the present invention, an outboard motor has an engine disposed within a housing of an outboard motor and forming a cavity between a portion of the engine and the housing. An oil container is disposed in the cavity between the engine and the housing. The outboard motor also has a pump enclosed in the oil container.

Various other features, objects and advantages of the present invention will be made apparent from the following detailed description and the drawings.

BRIEF DESCRIPTION OF DRAWINGS

The drawings illustrate one preferred embodiment presently contemplated for carrying out the invention.

In the drawings.

DETAILED DESCRIPTION

Figure 1:
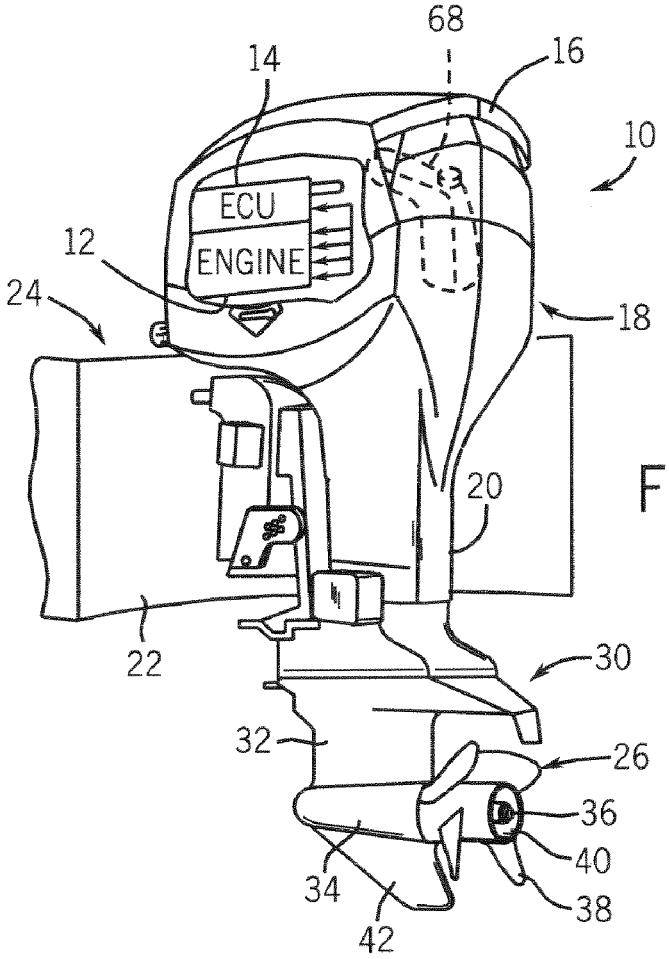
FIG. 1 is a perspective view of an exemplary outboard motor incorporating the present invention.

The present invention relates generally to internal combustion engines, and preferably, those incorporating a spark-ignited two-cycle gasoline-type engine having direct fuel injection. FIG. 1 shows an outboard motor 10 having one such engine 12 controlled by an electronic control unit (ECU) 14 under an engine cover 16. Engine 12 is housed generally in a powerhead 18 and is supported on a midsection 20 configured for mounting on a transom 22 of a boat 24 in a known conventional manner. Engine 12 is coupled to transmit power to a propeller 26 to develop thrust and propel boat 24 in a desired direction. A lower unit 30 includes a gear case 32 having a bullet or torpedo section 34 formed therein and housing a propeller shaft 36 that extends rearwardly therefrom. Propeller 26 is driven by propeller shaft 36 and includes a number of fins 38 extending outwardly from a central hub 40 through which exhaust gas from engine 12 is discharged via midsection 20. A skeg 42 descends vertically downwardly from torpedo section 34 to protect propeller fins 38 and encourage the efficient flow of outboard motor 10 through water. An oil tank 68 (shown in phantom) is mounted in close proximity to engine 12.

While many believe that two-stroke engines are generally not environmentally friendly engines, such preconceptions are misguided in light of contemporary two-stroke engines. Modern direct injected two-stroke engines and, in particular, EVINRUDE outboard motors, are compliant with not only today's emission standards, but emission standards well into the future. Further, the illustrated outboard motor has fuel injectors that are extremely fast and responsive. These injectors are not only state-of-the-art in terms of performance, they are so highly tuned that engines so equipped greatly exceed environmental emission standards for years to come. To obtain such exacting performance, the injectors operate at a rather high voltage, preferably 55 volts. In keeping with these design and performance objectives, eliminating remote oil tanks and the possible leaks that may develop from third party connections and hoses, and eliminating the need for multiple oil pumps is believed highly advantageous.

Figure 2:
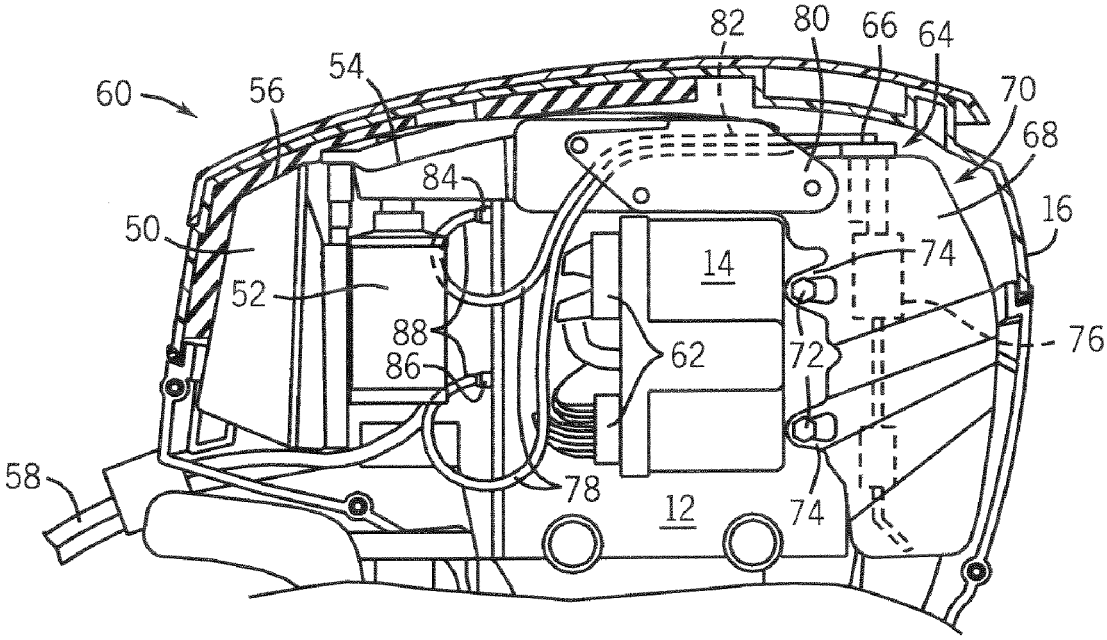
FIG. 2 is an elevational view of a portion of the outboard motor of FIG. 1 with a portion of the cover removed therefrom.

FIG. 2 shows such a system; however, before describing the oil system, the environment will be described to highlight the rigid restraints of placing all needed components in a compact housing. An air intake 50 is connected to engine 12 to allow passage of combustion gas from an atmosphere into engine 12. A starter 52 is attached to engine 12 and engages a flywheel (not shown) during starting of engine 12. A shroud 54 is disposed between the flywheel and a silencing insert 56 and prevents contact between the flywheel and silencing insert 56. A plurality of connection lines 58 extends from a front portion 60 of motor 10 toward the watercraft 24 to which the motor is attached. Connection lines 58 can include battery cables as well as control cables, such as a throttle cable, tilt/trim control lines, and engine monitor lines.

ECU 14 is mounted to engine 12 and includes a plurality of multi-pin connectors 62. Multi-pin connectors 62 connect ECU 14 to a plurality of engine sensors and allow for communication connectivity between an operator control area, such as a bridge, and engine 12. ECU 14 is programmed to control multiple engine systems such as an ignition system, an engine timing system, a cooling system, a fuel injection system, an air intake system, and a lubrication system. These systems are merely exemplary of engine systems that ECU 14 can be configured to control. It is understood that ECU 14 can be programmed to control additional engine systems not referenced above.

A lubrication system 64 includes a manifold 66 connected to a reservoir 68. Reservoir 68 is disposed within a cavity 70 formed between engine 12 and cover 16. A pair of fasteners 72 extend to engine 12 and engage a pair of bosses 74 integrally formed with reservoir 68. Such an engagement secures reservoir 68 to engine 12 within cover 16. A pump assembly 76, shown in phantom, is disposed within reservoir 68 and supplies lubrication fluid to manifold 66. A plurality of oil lines 78 extends from manifold 66 to engine 12. An oil line shield 80 secures a portion of oil lines 78 in respective chases 82 integrally formed in reservoir 68. Chases 82 secure oil lines 78 to reservoir 68 and prevent the lines from rubbing against the engine during motor operation. Such a construction reduces the potential for vibration-induced wear in the oil lines. A nipple 84, 86 is connected to an end 88 of each respective oil line 78. Nipples 84, 86 pass into a crankcase of engine 12 and fluidly connect reservoir 68 to engine 12.

Figure 3:
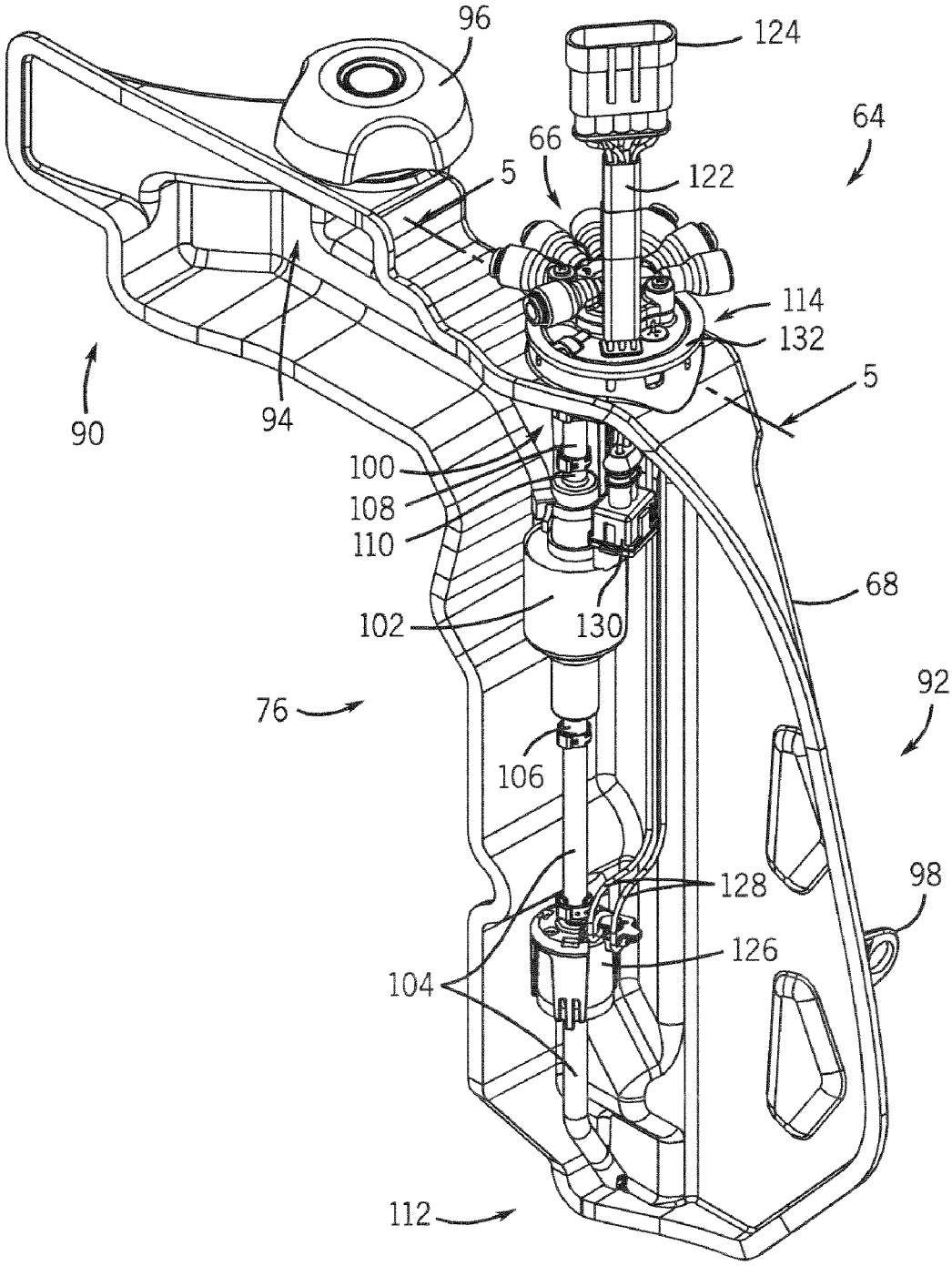
FIG. 3 is a sectional perspective view of an oil tank and pump assembly.

FIG. 3 shows a perspective view of the oil tank 68 and pump assembly 76 with one halve of the oil tank 68 removed therefrom. The oil tank 68 provides the only oil reservoir for the lubrication system 64. That is, preferably, the lubrication system 64 is wholly contained within the cover 16 of the outboard motor 10 and the boat does not supply any oil thereto. The oil tank 68 comprises two molded halves welded together to form a reservoir enclosure for the oil. The oil tank 68 is constructed to maximize available space between the engine 12 and the cover 16. The capacity of the oil tank 68 is also constructed to maximize the time between oil re-fills. Preferably, the oil tank has a 0.02 Litres/HP to 0.05 Litres/HP capacity, which comprises an average year's supply of oil for a given engine size.

The oil tank 68 has a lateral portion 90 and a longitudinal portion 92. The lateral portion 90 has a filler opening 94 therein to allow the oil tank 68 to be filled or re-filled with oil. The filler opening 94 has threads to allow a filler cap 96 to threadedly engage the oil tank 68 to prevent contamination of the oil and to prevent oil from spilling out of the filler opening 94. The pair of bosses 74 (shown in FIG. 2) is integrally formed with the longitudinal portion 92. The pair of bosses 74 is vertically offset from another. The longitudinal portion 92 further comprises another boss 98 horizontally offset from the pair of bosses 74 for mounting the oil tank 68 to the engine 12.

The longitudinal portion 92 of the oil tank 68 has a pump assembly opening 100 therein to allow the pump assembly 76 to pass therethrough. The pump assembly 76 is shown installed in the longitudinal portion 92 of the oil tank 68. The pump assembly 76 is described in further detail with regard to FIG. 4.

Figure 4:
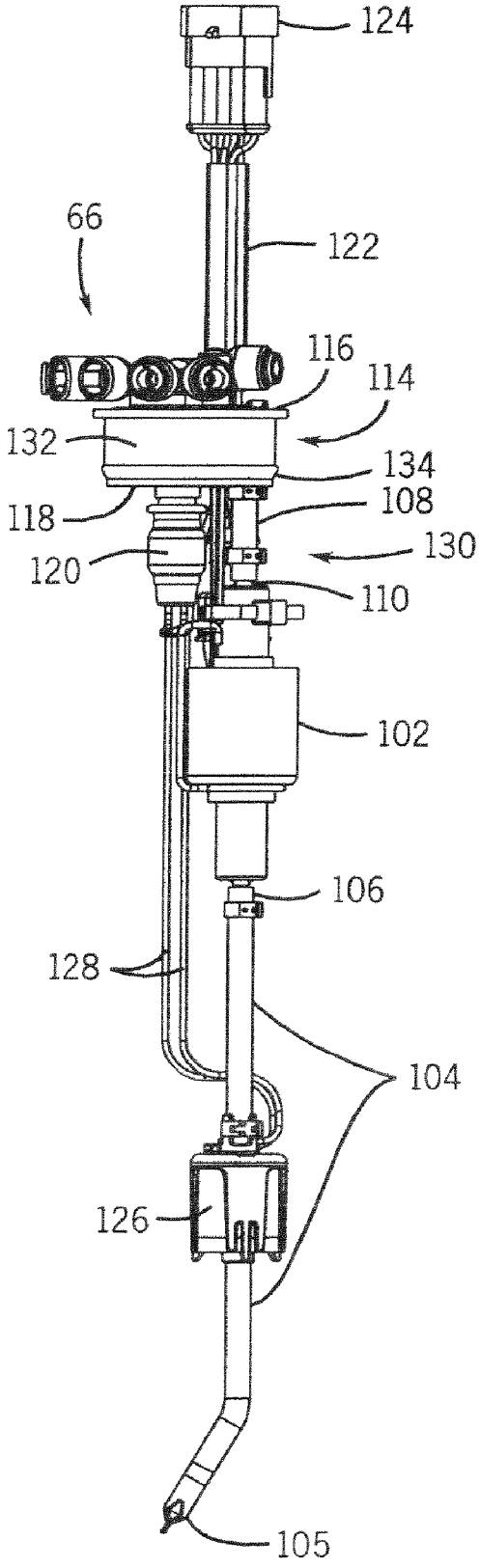
FIG. 4 is an elevational view of the pump assembly of FIG. 3.

FIG. 4 shows an elevational view of the pump assembly 76 of FIG. 3. A solenoid driven pump 102 is mounted inside the oil tank 68 and pumps oil to the engine 12. An oil pickup tube 104 is connected to an inlet 106 of the pump 102 and an oil output tube 108 is connected to an outlet 110 of the pump 102. The oil pickup tube 104 extends into a lower portion 112 of the oil tank 68 where a screen 105 is attached thereto so as to draw oil from the lowest practical part of the oil tank 68. A pump assembly cap 114 has a plurality of oil passages (not shown) therethrough. The manifold 66 mounts to a top 116 of the pump assembly cap 114 exterior to the oil tank 68. The oil output tube 108 fluidly connects pump 102 to a bottom 118 of the pump assembly cap 114. The oil passages in the pump assembly cap 114 fluidly connect pump 102 to manifold 66. A pressure switch 120 is attached to the pump assembly cap 114 and is fluidly connected to the oil passages therein to monitor oil pressure between pump 102 and manifold 66.

The pump assembly cap 114 also has an electrical wire passage (not shown) therethrough to allow a plurality of electrical wires 122 to pass from an interior of the oil tank 68 to an exterior of the oil tank 68, preferably, through one port. An ECU connector 124 allows for a quick connection of the plurality of electrical wires 102 to the ECU 14.

A float 126 slidingly engages the oil pickup tube 104 and indicates a level of oil in the oil tank 68. Wires 128 send oil level signals to ECU 14. When the level of oil in the oil tank 68 falls below a predetermined value, the float 126 sends a low oil level signal to ECU 14. A low oil level signal sent to the ECU 14 may cause the ECU 14 to operate the engine 12 in a limp-home mode until the oil level rises above the predetermined value.

Oil pressure in the oil passages is monitored by the pressure switch 120. If oil pressure in the oil passages is lower than a predetermined value, the pressure switch 120 sends an oil pressure signal to the ECU 14. Similar to the low oil level signal sent to the ECU 14, upon receiving a low oil pressure signal, the ECU 14 may cause the engine 12 to operate in a limp-home mode until oil pressure rises above the predetermined level. Such a mode limits engine operation, but allows a user some use of the motor.

A multi-pin connector 130 is connected to pump 102 inside the oil tank 68 and transmits ECU 14 pump operating signals to pump 102. Using a ratio of rated voltage and rail voltage to determine duty cycle, the ECU 14 provides a pulse width modulation (PWM) signal to an oil pump drive circuit (not shown) to control operation of pump 102. While it is contemplated that a DC to DC converter could be used to lower the rail voltage to a level equivalent to the pump's rated voltage, it is preferred to regulate power dissipation through PWM. With a DC to DC converter, the delay in energizing the pump 102 at engine start-up may cause a delay in pressurizing the lubrication system 64 that may be too long for efficient engine operation. Through the use of a novel PWM technique, the pump 102 is energized during engine start-up to pressurize the lubrication system 64 using a high voltage power source.

Figure 5:
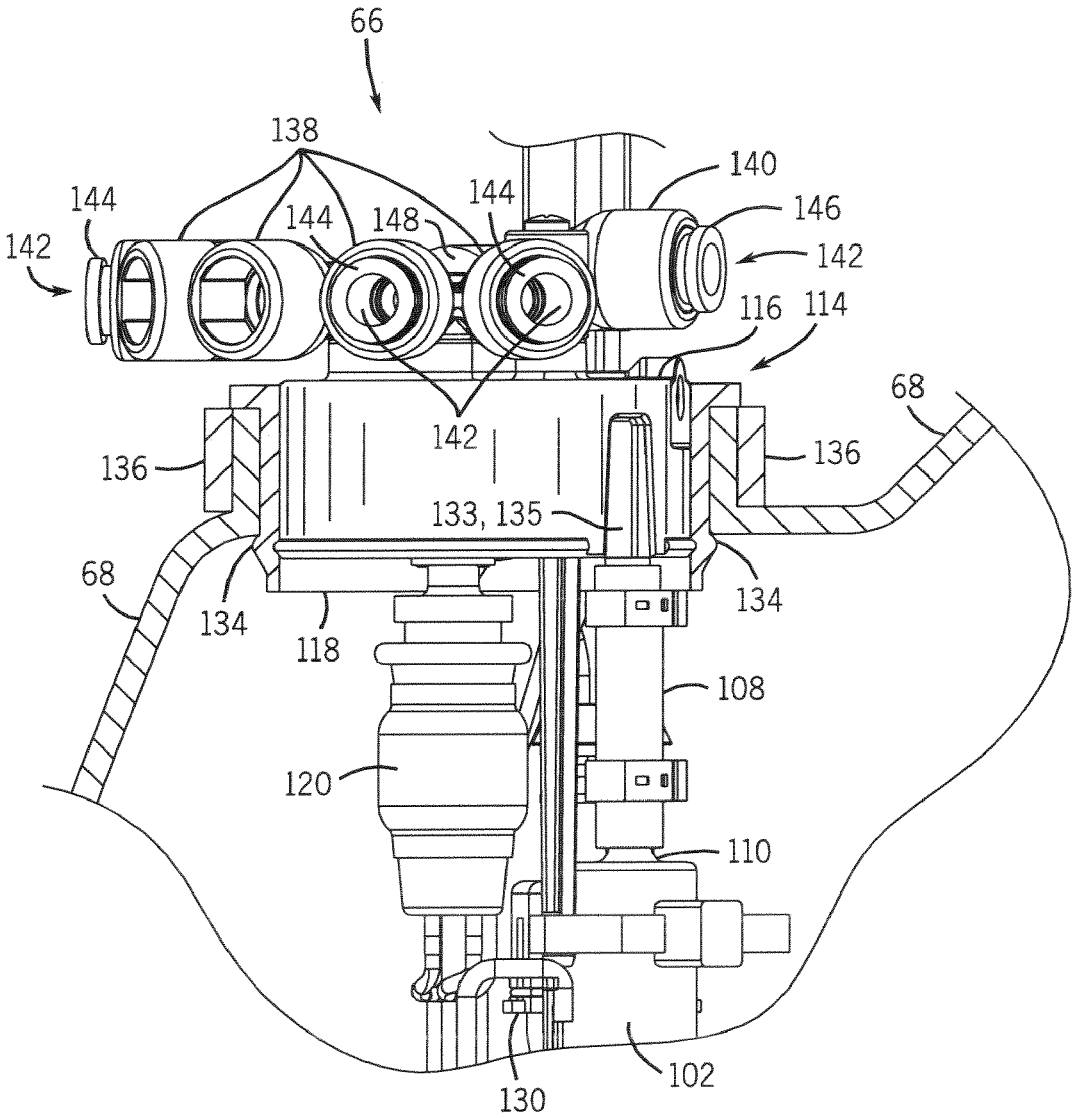
FIG. 5 is a cross-sectional view of a portion of the lubrication system of FIG. 3 taken along line 5-5.

FIG. 5 shows an enlarged view of FIG. 3 along lines 5-5. A pliable seal 132 sealingly engages the pump assembly cap 114 to the assembly opening 100. The pliable seal 132 includes a bulge 134 to provide tactile feedback when correctly placed in the assembly opening 100. The pliable seal 132 further includes a locator 133 used in mounting the pump assembly 76 to the oil tank 68. A corresponding locator 135 is positioned in the assembly opening 100 so as to match the locator 133 during system assembly. Matching the locators 133, 135 during assembly assures proper installation alignment of the pump assembly 76 in tank 68. A band clamp 136 securely fastens the pump assembly 76 and pump assembly cap 114 to the oil tank 68.

The manifold 66 has a plurality of cylinder outlet housings 138 for each cylinder of the engine 12 and a fuel system oiling outlet housing 140. The cylinder outlet housings 138 are angled equidistantly about a centrally-located dome 148. The appropriate number of cylinder outlet housings 138, as well as the fuel system oiling outlet housing 140, each has an outlet 142 containing a push-to-connect fitting 144, 146. The push-to-connect fittings 144 for the cylinder outlet housings 138 retain an oil line or hose 78 in fluid communication with the internal combustion engine. The push-to-connect fitting 146 for the fuel system oiling outlet housing 140 also retains a hose in fluid communication with a fuel separator of the fuel system. The push-to-connect fittings 144, 146 are designed to prevent leakage, allow easy coupling of the hoses, and allow easy decoupling of the hoses when needed.

The fuel system outlet housing 140 is shown preferably positioned at a higher elevation than the cylinder outlet housings 138 to purge air from the manifold 66 and the lubrication system 64. The positioning of the fuel system oiling outlet housing 140 above the cylinder outlet housings 138 allows air that accumulates in dome 148 to purge through the fuel system oiling outlet housing 140 to the fuel separator where it is vented. As shown, the cylinder outlet housings 138 share a plane that is significantly below the plane of the fuel system oiling outlet housing 140.

Figure 6:
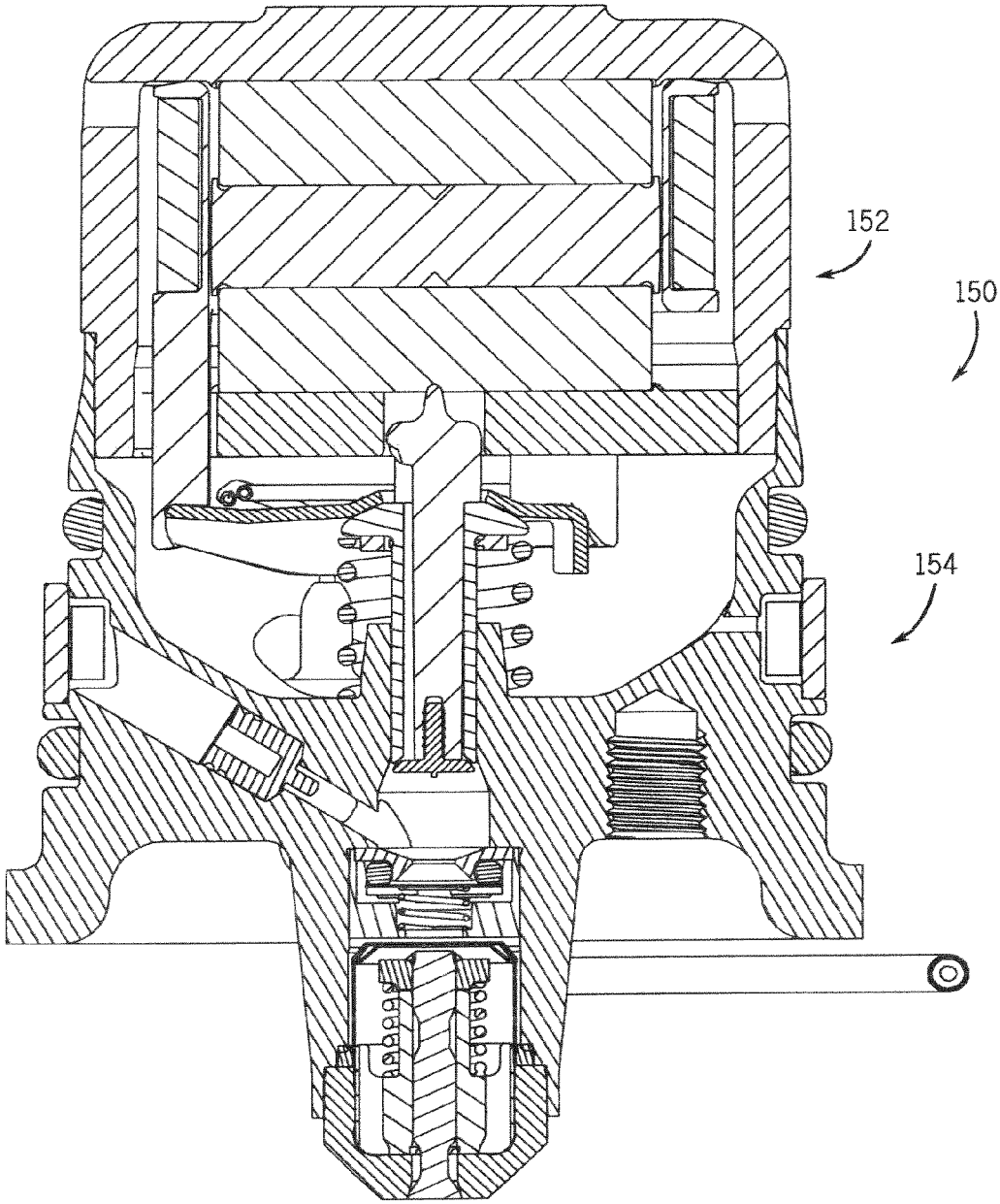
FIG. 6 is a cross-sectional view of an exemplary oil pump used in the present invention.

An exemplary reciprocating pump assembly, such as for use in an oil distribution system of the present invention, is shown in FIG. 6. Specifically, FIG. 6 illustrates a pump and nozzle assembly 150. Assembly 150 essentially comprises a drive section 152 and a pump section 154. The drive section 152 is designed to cause reciprocating pumping action within the pump section 154 in response to application of control signals applied to an actuating coil of the drive section 152. The characteristics of the output of the pump section 154 may thus be manipulated by altering the waveform of the signal applied to the drive section 152. In the presently contemplated embodiment, the pump and nozzle assembly 150 illustrated in FIG. 6 is particularly well-suited to application in an internal combustion engine, as in the components illustrated in FIGS. 3 and 4 as the solenoid driven pump 76.

Therefore, in accordance with one embodiment of the present invention, a lubrication system for an engine arranged to receive consumable lubricating oil has an oil reservoir mounted in close proximity to the engine. A pump is disposed within the oil reservoir and is the only oil pump in the lubrication system.

According to another embodiment of the present invention, an outboard motor has a two-stroke direct fuel injected engine mounted on a midsection of an outboard motor. The outboard motor also has a housing cover positioned about the engine and an oil tank positioned in the housing. A pump is disposed within the oil tank and in fluid communication with the engine.

According to a further embodiment of the present invention, an outboard motor has an engine disposed within a housing of an outboard motor and forming a cavity between a portion of the engine and the housing. An oil container is disposed in the cavity between the engine and the housing. The outboard motor also has a pump enclosed in the oil container.

The present invention has been described in terms of the preferred embodiment, and it is recognized that equivalents, alternatives, and modifications, aside from those expressly stated, are possible and within the scope of the appending claims. While the present invention is shown as being incorporated into an outboard motor, the present invention is equally applicable with other recreational products, some of which include inboard motors, snowmobiles, personal watercrafts, all-terrain vehicles (ATVs), motorcycles, mopeds, power scooters, and the like. Therefore, it is understood that within the context of this application, the term "recreational product" is intended to define products incorporating an internal combustion engine that are not considered a part of the automotive industry. Within the context of this invention, the automotive industry is not believed to be particularly relevant in that the needs and wants of the consumer are radically different between the recreational products industry and the automotive industry. As is readily apparent, the recreational products industry is one in which size, packaging, and weight are all at the forefront of the design process, and while these factors may be somewhat important in the automotive industry, it is quite clear that these criteria take a back seat to many other factors, as evidenced by the proliferation of larger vehicles such as sports utility vehicles (SUV).

What is claimed is:

1. An outboard motor comprising:

a two-stroke direct fuel injected engine mounted on a midsection of the outboard motor;

a housing positioned about the engine;

an oil tank positioned in the housing;

a pump disposed within the oil tank and in fluid communication with the engine;

a plurality of oil lines extending from the oil tank to the engine; and an oil line shield constructed to secure a portion of the plurality of oil lines to prevent the plurality of oil lines from rubbing against the engine during motor operation.

2. The outboard motor of claim 1 further comprising a tube connected to an inlet of the pump and extending into a lower end of the oil tank.

3. The outboard motor of claim 2 further comprising a float slidingly engaged to the tube and constructed to indicate a level of oil in the oil tank.

4. The outboard motor of claim 3 wherein the float is electrically connected to an ECU and wherein, if the float indicates the level of oil is below a predetermined level, the ECU controls the engine in a limp-home mode.

5. The outboard motor of claim 1 further comprising:

a manifold connected to receive oil from the oil tank and in fluid communication with the engine; and a pressure switch connected to the manifold to monitor oil pressure to the engine.

6. The outboard motor of claim 1 wherein the oil tank is constructed of two molded halves, joined by a weld, and wherein one half has two openings at an upper end, one of the openings threaded to receive a sealing cap therein for filling the oil tank.

7. The outboard motor of claim 6 wherein the oil tank is generally L-shaped having a longitudinal section and a lateral section and wherein the lateral section has the filler opening therein.

8. The outboard motor of claim 1 wherein the pump is mounted to a distribution manifold at one end and a float at another end to form a one-piece assembly insertable into the oil tank.

9. The outboard motor of claim 8 wherein the one-piece assembly includes a pliable seal at an upper end to engage an opening in the oil tank and provide an oil seal therebetween.

10. The outboard motor of claim 9 wherein the one-piece assembly further comprises a plurality of wires extending outwardly from the pliable seal.

11. The outboard motor of claim 8 further comprising an opening in the oil tank having a diameter that is greater than an outer diameter of the one-piece assembly.

12. The outboard motor of claim 1 if wherein the oil tank is sized according to engine size and wherein the oil tank is capable of holding an average year's supply of oil.

13. The outboard motor of claim 1 if wherein the oil tank has a 0.02 Liter/HP to 0.05 Liter/HP capacity.

14. The outboard motor of claim 1 further comprising an oil distribution hub having an inlet in fluid communication with the pump and having a plurality of outlets, at least one outlet fluidly connected to the engine.

15. The outboard motor of claim 14 wherein the plurality of outlets are quick connects.

16. The outboard motor of claim 1 wherein the engine and the housing form a cavity constructed to receive the oil tank therein.

17. The outboard motor of claim 1 if wherein the oil tank is a sole oil source.

18. The outboard motor of claim 1 further comprising:

an ECU; and a pressure switch connected to an outlet of the pump and to the ECU to indicate oil pressure from the pump.

19. An outboard motor comprising:

a two-stroke direct fuel injected engine mounted on a mid-section of the outboard motor;

a housing positioned about the engine;

an oil tank positioned in the housing; and a pump disposed within the oil tank and in fluid communication with the engine;

the pump comprising:

a drive section and a pump section; and a drive assembly disposed in the drive section, the drive assembly including at least one permanent magnet and a coil assembly disposed within a magnetic field of the at least one permanent magnet, the coil assembly movable reciprocally axially along a central axis upon application of power to the coil assembly.

20. The outboard motor of claim 19 wherein the drive assembly is in electrical communication with an ECU and is driven by a PWM signal.

21. An outboard motor comprising:

an engine disposed within a housing of the outboard motor and forming a cavity between a portion of the engine and the housing;

an oil container disposed in the cavity between the engine and the housing; and a pump enclosed in the oil container; the pump comprising:

a drive section and a pump section; and a drive assembly disposed in the drive section, the drive assembly including at least one permanent magnet and a coil assembly disposed within a magnetic field of the at least one permanent magnet, the coil assembly movable reciprocally axially along a central axis upon application of power to the coil assembly.

22. The outboard motor of claim 21 wherein the oil container has a lateral portion and a vertical portion.

23. The outboard motor of claim 22 wherein each portion of the oil container has an opening.

24. The outboard motor of claim 22 wherein the vertical portion further comprises a pair of bosses vertically offset from one another for mounting the oil container to the engine.

25. The outboard motor of claim 24 wherein the vertical portion further comprises another boss horizontally offset from the pair of bosses for mounting the oil container to the engine.

26. The outboard motor of claim 22 wherein a depth of the vertical portion is greater than a length of the lateral portion.

27. The outboard motor of claim 21 wherein the oil container has a shape that substantially matches a shape of the cavity.

28. The outboard motor of claim 21 further comprising at least one boss integrally formed with the oil container and configured to secure the oil container to the engine.

29. The outboard motor of claim 21 wherein a pressure switch and a float are enclosed in the oil container.

30. The outboard motor of claim 21 wherein the oil container is a sole source of oil.

31. The outboard motor of claim 21 wherein the pump is in electrical communication with an ECU and is driven by a PWM signal.

32. The outboard motor of claim 21 further comprising:

an ECU; and a pressure switch connected to an outlet of the pump and to the ECU to indicate oil pressure from the pump.

33. An outboard motor comprising:

an engine disposed within a housing of the outboard motor and forming a cavity between a portion of the engine and the housing;

an oil container disposed in the cavity between the engine and the housing; and a pump enclosed in the oil container;

wherein a pressure switch and a float are enclosed in the oil container;

wherein the float is electrically connected to an ECU and wherein, if the float indicates an oil level below a predetermined level, the ECU controls the engine in a limp-home mode.

* * * * *